US008794159B2

(12) United States Patent
Andre et al.

(10) Patent No.: US 8,794,159 B2
(45) Date of Patent: Aug. 5, 2014

(54) DEFORMABLE ASSEMBLY ACTING AS AN INTERCOMMUNICATING GANGWAY BETWEEN TWO CONSECUTIVE BODIES HAVING WHEELED BASES

(75) Inventors: Jean-Luc Andre, Molsheim (FR); Serge Brion, Stutzheim (FR)

(73) Assignee: Lohr Industrie, Hangenbieten (FR)

( * ) Notice: Subject to any disclaimer, the term of this patent is extended or adjusted under 35 U.S.C. 154(b) by 221 days.

(21) Appl. No.: 13/503,920

(22) PCT Filed: Oct. 21, 2010

(86) PCT No.: PCT/IB2010/054771
§ 371 (c)(1),
(2), (4) Date: Jul. 2, 2012

(87) PCT Pub. No.: WO2011/051862
PCT Pub. Date: May 5, 2011

(65) Prior Publication Data

US 2012/0260438 A1 Oct. 18, 2012

(30) Foreign Application Priority Data

Oct. 30, 2009 (FR) ..... 09 05226

(51) Int. Cl.
*B60D 5/00* (2006.01)
*B61D 17/20* (2006.01)
*B61D 3/18* (2006.01)

(52) U.S. Cl.
CPC ..... *B61D 17/20* (2013.01); *B61D 3/187* (2013.01)
USPC ..... 105/8.1; 105/15

(58) Field of Classification Search
CPC ..... B61D 17/22; B61D 17/20; B61D 17/04; B60D 5/00; B60D 5/006; B60D 5/003
USPC ..... 105/8.1, 9, 10, 11, 15, 16, 17, 18, 19, 105/20
See application file for complete search history.

(56) References Cited

U.S. PATENT DOCUMENTS

| | | | | |
|---|---|---|---|---|
| 5,060,577 | A * | 10/1991 | Steinmetz | 105/15 |
| 6,401,626 | B1 * | 6/2002 | Goebels et al. | 105/18 |
| 7,392,748 | B2 * | 7/2008 | De Antonio et al. | 105/8.1 |
| 7,568,435 | B2 * | 8/2009 | Mosaner | 105/20 |
| 7,971,924 | B2 * | 7/2011 | Tabellini et al. | 296/178 |
| 2005/0183621 | A1 * | 8/2005 | Antonio et al. | 105/8.1 |

FOREIGN PATENT DOCUMENTS

| | | | |
|---|---|---|---|
| DE | 737116 | | 7/1943 |
| DE | 3305062 | A1 | 8/1984 |
| DE | 10023701 | A1 | 11/2001 |
| EP | 0293051 | A1 | 11/1988 |

(Continued)

*Primary Examiner* — Jason C Smith
(74) *Attorney, Agent, or Firm* — Davis & Bujold, PLLC; Michael J. Bujold

(57) ABSTRACT

A deformable assembly which comprises an assembly of flexible metal leaves which each include a central portion having a side arm that extends from each end. The leaves are placed standing on edge, stacked against one another and attached by a central portion to the end of a plate supported by a wheeled base. The lateral arms of the assembly remain elastically deformable. The deformable assembly preferably comprises an extension of the leaves by acting on the end leaf. An intercommunicating gangway, between two consecutive plates, is manufactured using one or two of the deformable assemblies, each one of which is mounted on one of the opposing ends of the two plates and independent from the other leaf and/or from the other plate.

18 Claims, 6 Drawing Sheets

(56) References Cited

FOREIGN PATENT DOCUMENTS

| | | | |
|---|---|---|---|
| EP | 0562598 | A1 | 9/1993 |
| EP | 1568519 | A1 | 8/2005 |
| FR | 2764856 | A1 | 12/1998 |

* cited by examiner

DEFORMABLE ASSEMBLY ACTING AS AN INTERCOMMUNICATING GANGWAY BETWEEN TWO CONSECUTIVE BODIES HAVING WHEELED BASES

This application is a national stage completion of PCT/IB2010/054771 filed Oct. 21, 2010 which claims priority from French Application Serial No. 09 05226 filed Oct. 30, 2009.

FIELD OF THE INVENTION

The present invention relates to a deformable assembly acting as an intercommunicating gangway between two adjacent platforms or plates supported on a wheeled base or on two consecutive wheeled bases pulled by a connecting element.

BACKGROUND OF THE INVENTION

Intercommunicating gangways between two consecutive platforms supported by one or more wheeled bases have been developed for passenger transport and also for transporting merchandise, particularly road vehicles and other motorized loads on wheels or merchandise to be moved, lifted or displaced by handling devices on wheels during loading and unloading operations.

To facilitate loading and unloading operations, it is very desirable to be able to circulate from one platform to another without the need to descend from the wheeled base upon reaching the end, only to then ascend the next platform.

The existence of intercommunicating gangways between platforms also reduces the number of access ramps or handling and lifting means required, since they are needed only for the two wheeled bases located at the ends of the convoy.

However, the presence of these intercommunicating gangways must not cause any problems while the convoy of bodies on wheeled bases is moving. During travel, the space between the opposing extremities of two consecutive platforms of two consecutive wheeled bases undergoes significant changes with regard to both dimension and shape due to the topology of the route or variations in driving, for example, when taking curves, moving over depressed or raised surfaces or slopes, or because of braking, acceleration or jolting.

The intercommunicating gangways must be able to adapt easily to these variations or deformations in the space between platforms without causing any difficulties during travel.

The problem is further complicated when the height or angle of the plates or platforms relative to one another varies, which is the case, for example, with wheeled bases supporting loading platforms for vehicle transport.

Intercommunicating gangways for passengers are quite specialized, as they require overhead protection to seal off the assemblies from the outside environment.

Insofar as merchandise is concerned, this protection is needed only rarely or not at all, as the merchandise is individually protected. This is especially true when transporting vehicles. In this instance, intercommunicating gangways developed by the prior art conventionally consist of a connecting structure between the two opposing transverse edges of two consecutive platforms or plates.

The simplest and most current prior art construction uses pivoting connecting flaps. These pivoting flaps, which are two in number, when folded and deployed, serve as the intercommunicating connection between consecutive plates. Each flap has one end that is attached either to or near the transverse end edge of one plate and pivots, and another end that rests after pivoting on a contact area near the opposing transverse end edge of the successive plate. The flaps are each articulated to an opposing transverse end edge so as to constitute a passageway between two folding deployable elements.

When the loading and unloading operations are complete, these flaps must be manually folded back onto the platform they are connected to so they do not interfere with travel.

Despite being particularly simple, this passageway structure is not without various drawbacks. The principal one is the necessity for the operator to deploy and then fold up the various flaps on the intercommunicating passageways; an oversight on the operator's part could cause damage to the flaps or the end of the plate during travel.

Moreover, this structure is only used during loading and unloading operations. During travel it is impossible to leave cargo such as, for example, a vehicle, on this structure, with one portion on one of the plates and another portion on the other plate.

Additionally, plates of adjustable height or angle present another risk when different adjustments are made on two successive plates.

When the flaps are deployed, wide amplitude movements between the two successive plates joined in this way, especially during positioning and adjustment maneuvers may cause the flaps to disconnect.

When the end of one of the plates rises, the folded flap connected to the other plate begins to lift up, then finally falls flat if the motion continues. It then becomes an obstacle to the upper platform returning to its initial, or lower, position and there is a risk it will be damaged.

Obviously, operators take care to avoid breakage. They supervise maneuvers throughout the entire process of positioning the plates during the loading and unloading preceding or following the transportation phase, and they proceed to deploy and fold the flaps as necessary. However, the possibility of an oversight cannot be completely eliminated.

SUMMARY OF THE INVENTION

The goal of the present invention is to furnish a deformable assembly forming an intercommunicating gangway between two successive plates on one or two consecutive wheeled bases that eliminates the disadvantages of the prior art system.

The present invention relates to an intercommunicating gangway between two consecutive supporting plates in the form of one or two independent deformable structures that are adjacent but not connected, which permits maneuvers and adjustments in the plates' position, height or angle without any risk of interference and while maintaining maximum separation between them.

Because of its deformability, this intercommunicating gangway can adapt to differences in the shape of the travel path or route such as dips, bumps, or slopes, as well as any changes in level or orientation, when moving together or separating during travel, or when braking, accelerating, turning, or being jolted.

The intercommunicating gangway according to the invention is used when stopped during loading and unloading. But it remains in place without causing any difficulty during travel or while the plates are maneuvered relative to one another.

The operator no longer has to intervene when deploying or retracting the gangway, thereby eliminating any chance of forgetting and causing damage, and appreciably shortening the time required for the loading and unloading operations.

In addition, it advantageously can be used as a holding area during travel, since cargo such as a vehicle, for example, can be placed on the passage area with one portion on one of the plates and the other portion on the other plate.

To resolve the technical problem, the invention furnishes a deformable assembly for attachment to the end of a plate or platform on a wheeled base in the free space separating this plate from another plate opposite it in order to form an interconnecting gangway between these two consecutive platforms.

According to the invention this deformable gangway comprises an assembly of flexible metal leaves, preferably trough-shaped, each comprising a central portion that extends into a lateral arm on either side.

These leaves stand on their edges, juxtaposed and stacked on one another, and they are attached by their central portion to the end of the platform, while their lateral arms remain elastically deformable.

The deformable assembly is independent of the plate opposite it and it comprises a terminal leaf that corresponds to the leaf farthest from the extremity of the platform to which it is attached.

Additionally, the deformable assembly preferably comprises an extension abutment device to limit extension by the leaves, operating on the terminal leaf, for example.

The leaves, with extremities that draw together and become superimposed when the stack is totally compressed, are preferably attached by an elastic recall means beyond the transverse end edge and the abutment device limits their deployment.

The invention therefore furnishes an intercommunicating gangway between two successive plates or platforms supported by a wheeled base or two successive wheeled bases and separated by an empty space, comprising at least one such deformable assembly.

According to a preferred embodiment of the invention, this intercommunicating gangway comprises two deformable assemblies independent of each other and attached opposite each other in the free space separating the two plates, with each one facing two successive plates at one of the extremities.

BRIEF DESCRIPTION OF THE DRAWINGS

The invention also teaches one plate for a wheeled base comprising one deformable assembly of this type attached to at least one of its extremities.

Other characteristics and features of the invention will be apparent from reading the following detailed description with reference to the attached drawings, in which.

DETAILED DESCRIPTION OF THE DRAWINGS

Figure 1:
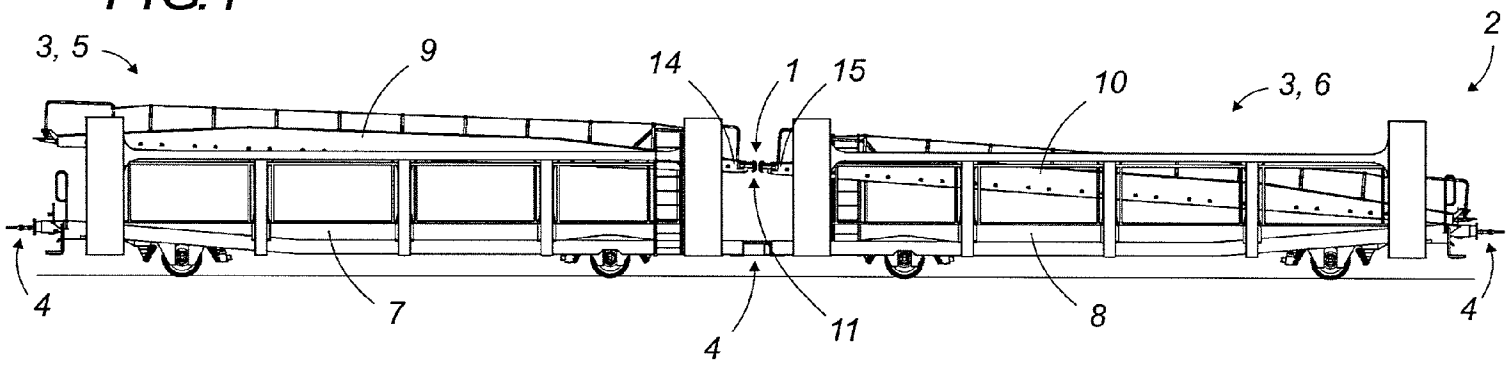
FIG. 1 is a general profile view of two wheeled railway bases equipped with an intercommunicating gangway according to the invention between their upper platforms.

The deformable assembly and the intercommunicating gangway of the present invention will now be described in detail with reference to FIGS. 1 through 20. Equivalent elements shown in different drawings will bear the same reference numerals.

FIG. 1 shows an example of a preferred application of an intercommunicating gangway 1 according to the invention. It is a portion of a railway convoy 2 on wheeled bases 3 connected to one another by a conventional bogie or other type of coupling means 4 and pulled by a motorized locomotive type vehicle (not shown) placed at the front of the convoy.

Only two successive wheeled bases 3, respectively denoted as front wheeled base 5 and rear wheeled base 6, are shown in FIG. 1. Each of these wheeled bases 5, 6 comprises a lower plate or platform, 7 and 8, respectively, and an upper plate or platform, 9 and 10, respectively, specifically designed for transporting vehicles.

To facilitate loading and unloading operations, upper platforms 8 can be angled and they are adjustable in height.

An intercommunicating gangway 1 according to the invention is located in the free space 11 separating upper platform 9 on the front wheeled base 5 from upper platform 10 on rear wheeled base 6.

Obviously this is only one preferred exemplary application of the invention. The intercommunicating passageway of the invention may equip all types of wheeled bases, whether for road or rail travel, designed for transporting vehicles or any other type of merchandise, even passengers.

The interconnecting gangway according to the invention is particularly advantageous when there are successive plates or platforms of varying heights or angles. However, it can be used with plates or platforms of fixed height and/or angle.

Moreover, although it has been shown between upper platforms 9 and 10 in FIG. 1, it may also or alternatively be located near lower plates or platforms 7 and 8 on successive wheeled bases 5, 6.

Similarly, it may be used both when wheeled bases 3 comprise only a single platform or when they comprise more than two platforms in order to form an intercommunicating gangway between each platform or between only certain successive platforms.

Finally, it may also be used between two successive platforms or plates supported by the same wheeled base.

A preferred embodiment of intercommunicating gangway 1 of the invention will now be described with reference to FIGS. 2 through 18.

Intercommunicating gangway 1 comprises a deformable assembly 12, elastically compressible and/or extendible, attached to the extremity 14 of plate 9 on wheeled base 5 in the empty space 11 separating the plate 9 from opposing plate 10 opposite. This deformable assembly 12 is independent of opposing platform 10.

According to a first embodiment of the invention, not shown, intercommunicating gangway 1 may comprise only a single deformable assembly 12 attached to the extremity of either of the two plates, while the extremity of the other facing plate remains free and not connected to deformable assembly 12.

According to another embodiment of the invention, which is preferred and shown in the different drawings, the intercommunicating gangway may comprise two deformable assemblies 12 and 13 which are independent and each placed at one extremity 14 and 15, respectively, facing successive plates 9 and 10. The two deformable assemblies 12 and 13 may contact each other, but they are not joined to each other. The juxtaposition and extension of the assemblies forms intercommunicating gangway 1 of the invention.

Each deformable assembly 12, 13 consists of a succession of metal leaves 16 attached at extremity 14 or 15 of corresponding plate 9 or 10, and preferably at the transverse edge 17 or 18, respectively, of this extremity 14 or 15.

The transverse dimension of this deformable assembly 12, 13 preferably is generally equal to the width of plate 9 or 10 on which it is mounted.

Metal leaves 16 are generally flat and comprise a central portion 19 prolonged by two lateral arms 20, each extending from one side of central portion 19.

According to a preferred embodiment of the invention, these leaves 16 have a generally trough-shaped profile extending on each side into an end branch 21, preferably parallel to the base of the trough. This profile is characterized by its planar central portion 19, which is horizontal, for example, extending on each side into an oblique lateral blade 22 followed by end branch 21 which is preferably parallel to planar central portion 19 or divergent while in resting position. Thus, in this preferred situation, lateral arms 20 are each formed of one oblique lateral blade 22 and one end branch 21.

Leaves 16 are preferably made of a single piece except for terminal leaf 23 on each deformable assembly 12, 13, that is, the one on the extremity, which is preferably made in two pieces to facilitate attachment, for example, it may be formed of two half-leaves 24 as described below.

These leaves 16, 23 are not arranged to be flat, but stand up on their edges and are juxtaposed against one another in a stack.

They are attached at their central portion 19 at extremity 14, 15 of corresponding supporting platform 9, 10. For this reason they may be joined one to the other, through one another, or held flat against each other with a bolt or any other means of attachment or retention.

In the example shown, leaves 16 and 23 are attached to transverse edge 17 or 18 of each opposing extremity 14, 15 of supporting plates 9, 10 using an assembly of bolts 25 penetrating a series of openings 26 formed in central portion 19 of leaves 16 placed flat against each other, then a series of openings 27 formed in the transverse edge 17, 18 of plate 9, 10 and are locked to the rear of this transverse edge 17, 18 by an assembly of screws, not shown.

To allow the different leaves 16 in the stack to be juxtaposed, successive leaves 16 in each deformable assembly 12, 13 may have lateral arms 20 that widen progressively from terminal leaf 23 to the leaf placed closest to extremity 14, 15 of plate 9, 10; or even, as in the example shown, lateral arms 20 may be parallel in resting position with central portion 19 increasing in length from end leaf 23 to the leaf placed closest to extremity 14, 15 of plate 9, 10.

Since lateral arms 20 of leaves 16 are metal with unattached ends, they are capable of deformation following compression or release, as will be seen below, Thus, oblique lateral blades 22 and end branches 21, or more generally lateral arms 20, may adopt different orientations when compressed or released. The profile of leaves 16 may widen when lateral arms 20 separate after compression or conversely, it may narrow after release.

Similarly, during use, the two lateral arms 20 on each leaf 16 are not necessarily symmetrical, as each one may adopt a different orientation depending upon the compressing or releasing forces it is subjected to and it is not necessarily identical to its counterpart.

Consecutive portions of each leaf 16, 23 change direction using an elbow or a bend, such as 28, for example, formed in the leaf structure to keep the leaf assembly 16, 23 flexible by making it capable of deformation when supporting plate 9, 10 is pushed or extended longitudinally.

In the preferred embodiment shown, terminal leaf 23 advantageously has a different shape from the other leaves 16. Its lateral arms 20 each extend towards the rear, that is, in the direction of plate 9, 10 to which deformable assembly 12, 13 is attached, by longitudinal return 28 to form an extension abutment.

Each of these longitudinal returns 28 cooperates with a retention means 29 located on corresponding plate 9, 10 to form an extension abutment 30. This abutment 30 may assume various technical forms. It may consist, as shown, of an extremity of longitudinal return 28 that slides inside guide 31, for example a bridge attached to the portion of side 32, 33 of the plate 9, 10 concerned and serving as a retention means 29 cooperating with a blocking end shape 34 on each longitudinal return 28, for example, one that is shaped like a T or an angle-iron, limiting the extension of leaves 16.

The role of abutment device 30 is to retain terminal leaf 23 by each of its extremities during extension by imposing a maximum extension limit on them in which extension block 34 abuts guide 31 and opposes any supplemental extension.

By retaining terminal leaf 23, abutment device 30 as a result also retains all the other leaves 16 in the stack that are wedged between terminal leaf 23 and transverse edge 17, 18 of corresponding plate 9, 10.

Leaves 16 and 23 preferably are maintained under elastic tension that is pre-constrained, regardless of their position. For this purpose, leaves 16, 23 preferably are made of highly elastic metal and attached under elastic compression. During maximum extension movement limited by abutment device 30, they retain an elastic constraint so as to allow recall from extension and they are elastically durable during compression as determined by their construction.

This prestressing advantageously reduces bothersome noise during travel by eliminating vibration by leaves 16, 23 in deformable assemblies 12, 13.

In addition, when a vehicle moves over deformable assemblies 12, 13 and thus over the edge of leaves 16, 23, a resisting force originates from this prestressing which opposes the driving force exerted on the leaves by the vehicle's wheels during movement. This resisting force prevents the undesirable displacement of leaves 16, 23; without it, a dangerous empty space could appear due to separation of the leaves or the deformable assemblies.

Terminal leaf 23 of each deformable assembly 12, 13, comprises a contact piece 35 forming a buffer, located at the extremity of each of its lateral arms 20, preferably at the angle corresponding to the point of origin of each longitudinal return 28.

When intercommunicating gangway 1 comprises two facing deformable assemblies 12, 13, contact pieces 35 of terminal leaf 23 on deformable assembly 12, 13 enter into contact with counterpart contact pieces 35 on terminal leaf 23 of opposing deformable assembly 12, 13. In the case of an intercommunicating gangway 1 comprising only a single deformable assembly 12, contact pieces 35 on its terminal leaf 23 cooperate with the end edge of the opposing plate when they are located in contact with it.

Each contact piece 35 preferably has a rounded enveloping shape with a central portion 43, a lateral side 36, an upper surface 37 and a lower surface 38 both curved toward the rear, that is, toward plate 9, 10 on which deformable assembly 12, 13 is mounted.

At the corner it forms a generally rounded contact area constituting a sliding support to provide a fixed or movable contact on the front surface as well as on the diagonal. This is to maintain supporting contact not only when pushed forward in a straight line, but also obliquely when the plates are angled because of variations in shape of the road or the travel route such as slopes, elevations, depressions in the road level or adjustments to the plates.

According to another possible embodiment, upper surface 37 and/or lower surface 38, rather than being limited to contact piece 35, may extend along a portion or the totality of terminal leaf 23 so as to cover or completely or partially envelop the other leaves 16 when the device is compressed.

Contact piece 35 may advantageously be made of the same piece as terminal leaf 23 as shown in the example. It may also be a separate piece, made independently and attached later to terminal leaf 23. It is then attached at the angle separating end branch 21 from longitudinal return 28 in any way that can be conceived by a person skilled in the art.

According to another variation, not shown, longitudinal return 28 may also be made as an independent piece added on to terminal leaf 23 by any suitable method or to contact piece 35. It may also be made as a single element with contact piece 35, the entire unit being independent of terminal leaf 23, added on and attached to the leaf by any suitable method.

When longitudinal return 28 is not formed as one piece with terminal leaf 23, the latter may advantageously be made of a single element like the rest of leaves 16 and no longer in the form of two half leaves 24.

It is also conceivable for another embodiment of the invention to have the longitudinal return 28 that slides in a guide 31 fixed to side 32, 33 of the plate 9 or 10 concerned be replaced, for example, by two longitudinal returns extending toward the plate concerned, one toward the top and the other toward the bottom of the plate concerned, the two returns each sliding in a guide respectively attached to the upper plate surface of one and the lower plate surface of the other.

Figure 20:
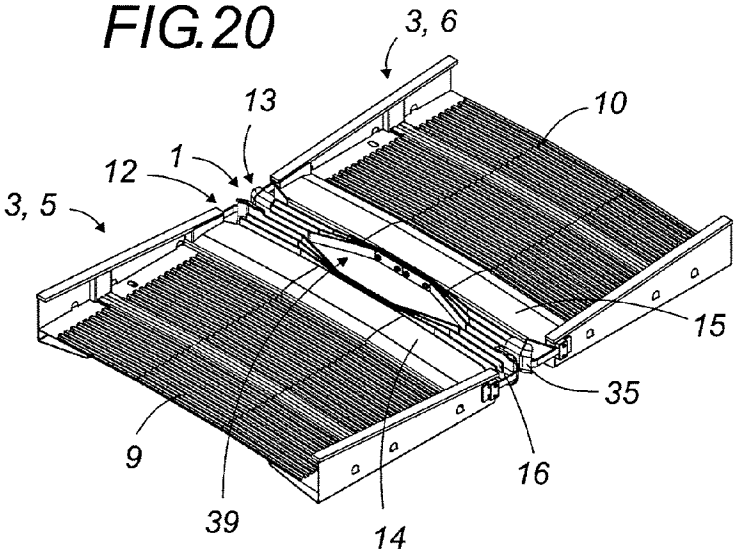
FIGS. 19 through 20 are overhead and perspective views, respectively, showing a second simplified embodiment of the intercommunicating gangway according to the invention during passage in a straight line.
Figure 19:
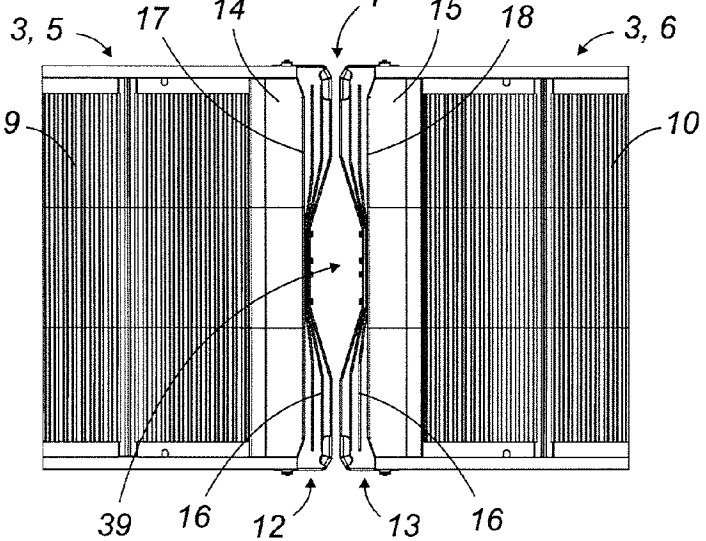
Figure 4:
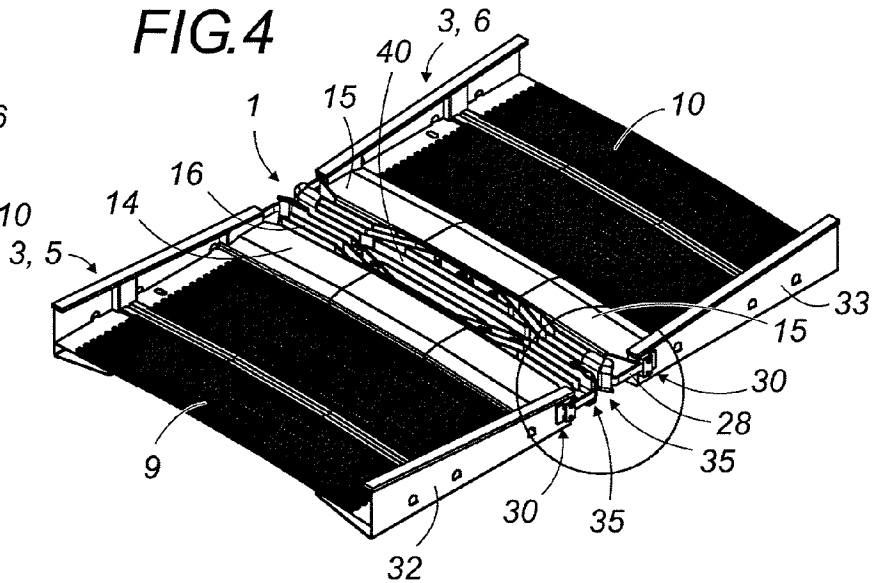
FIGS. 2 through 5 are overhead, profile, perspective and enlarged detail views, respectively, showing a first embodiment of the intercommunicating gangway according to the invention during passage along a straight line.
Figure 5:
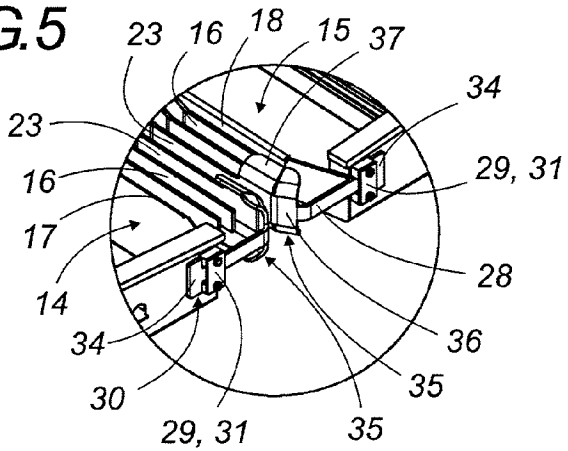
Figure 2:
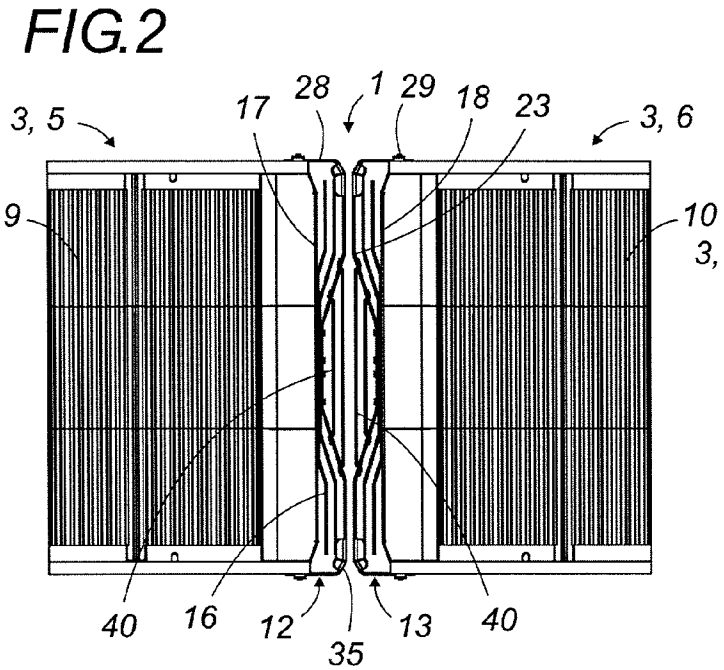
Figure 3:
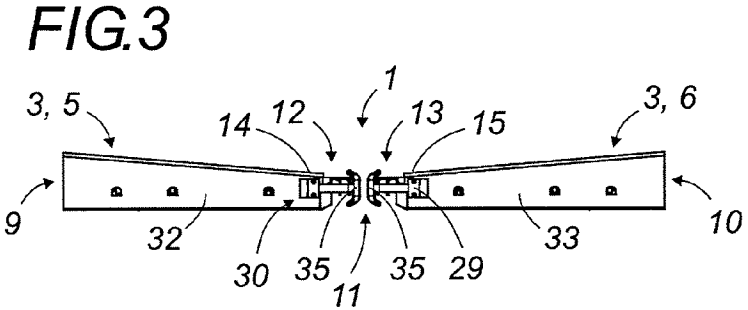
Figure 8:
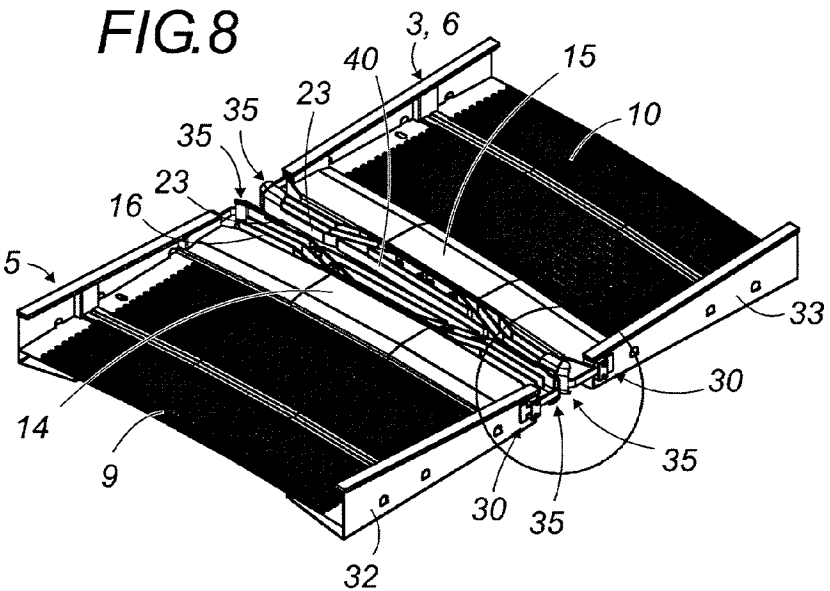
FIGS. 6 through 9 are overhead, profile, perspective and enlarged detailed views, respectively, showing the intercommunicating gangway according to the first embodiment of the invention during passage along a curve.
Figure 9:
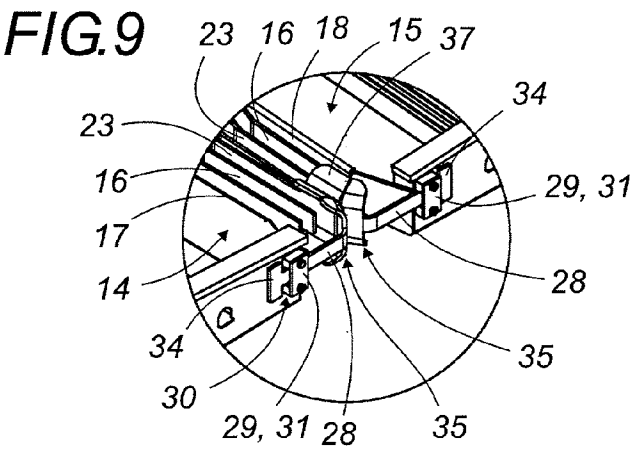
Figure 6:
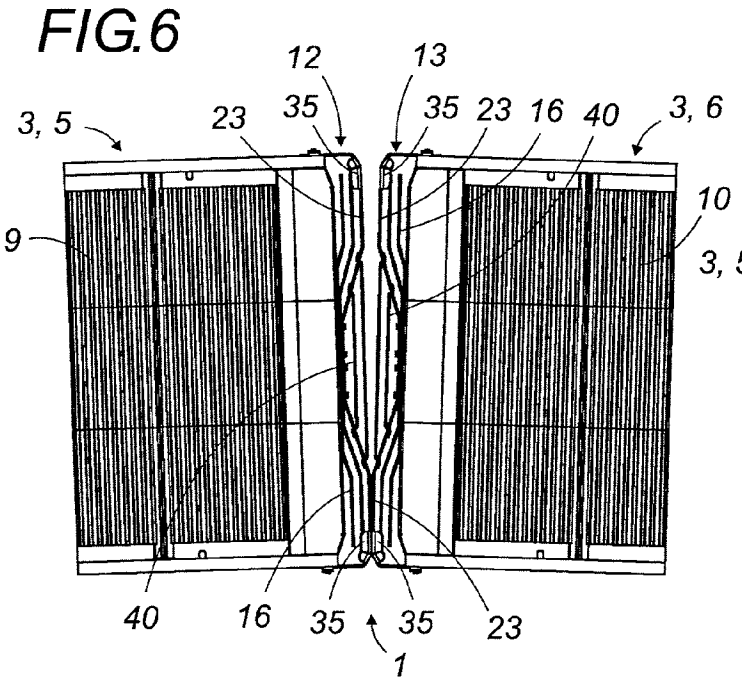
Figure 7:
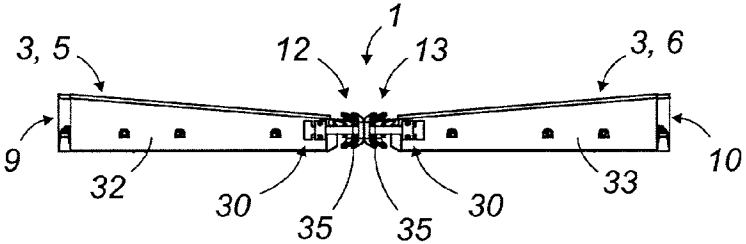
Figure 12:
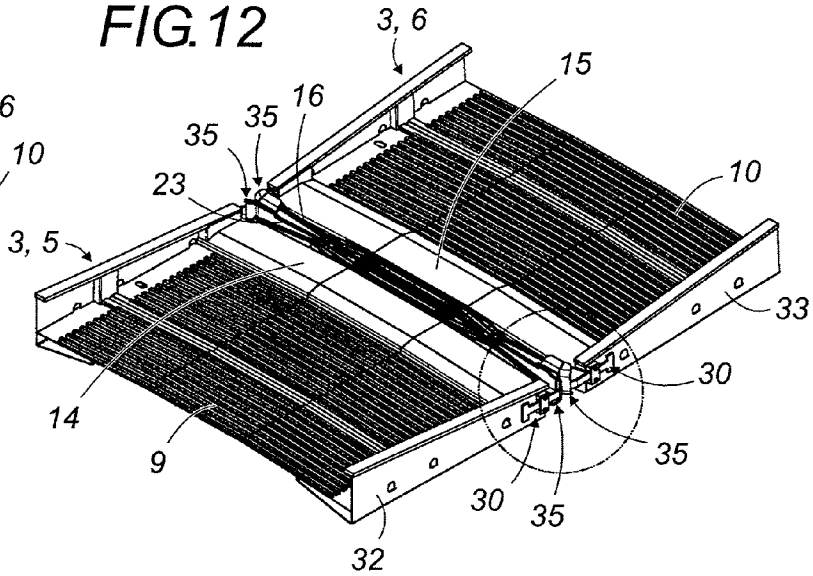
FIGS. 10 through 13 are overhead, profile, perspective and enlarged detail views, respectively, showing the intercommunicating gangway according to the first embodiment of the invention during passage over a dip.
Figure 13:
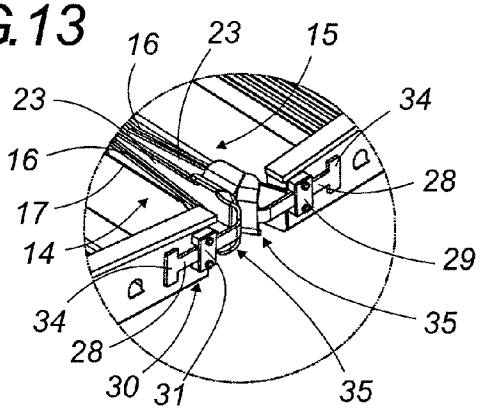
Figure 10:
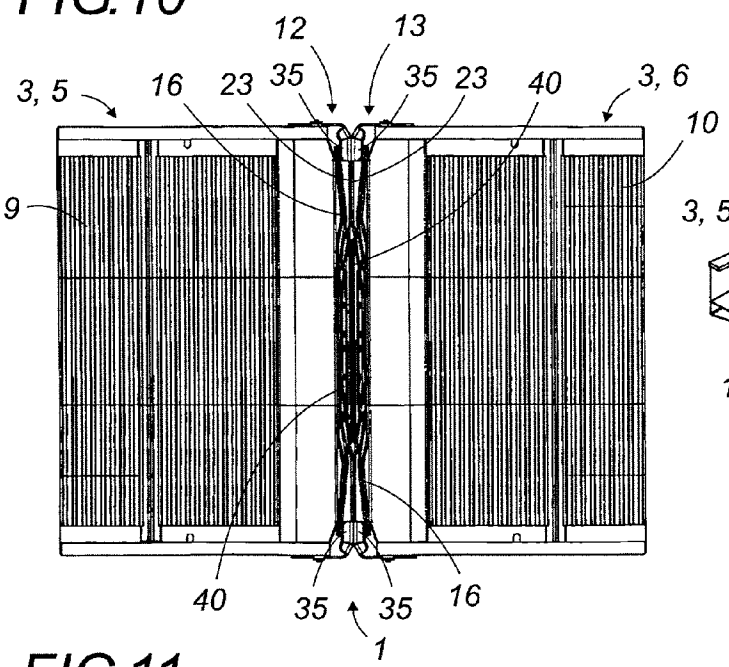
Figure 11:
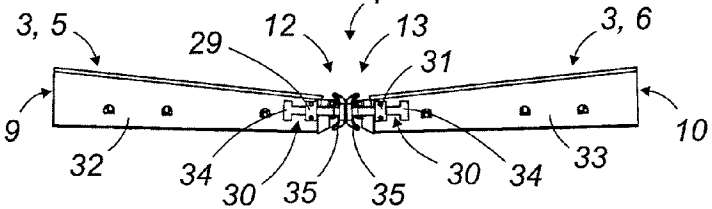
Figure 16:
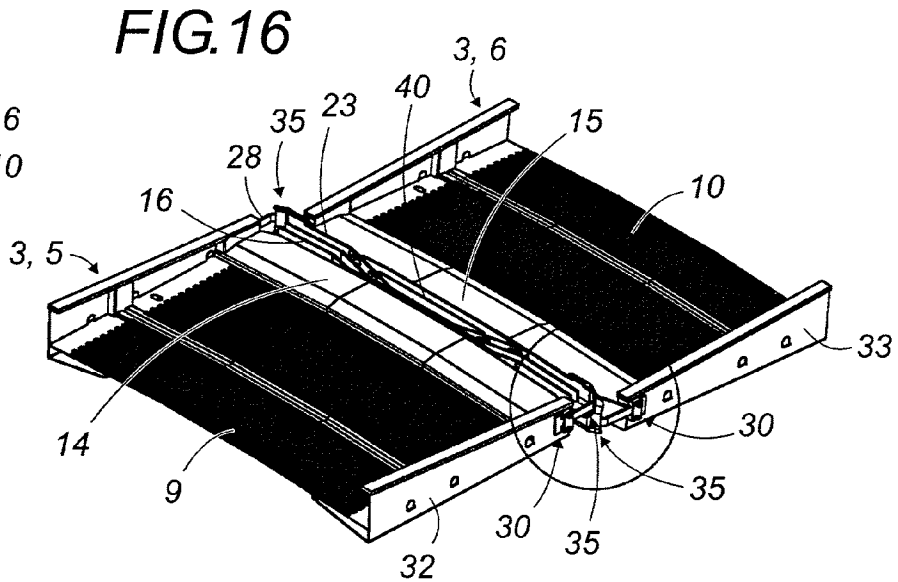
FIGS. 14 through 17 are overhead, profile, perspective and enlarged detail views, respectively, showing the intercommunicating passageway according to the first embodiment of the invention while maneuvering one of the plates.
Figure 17:
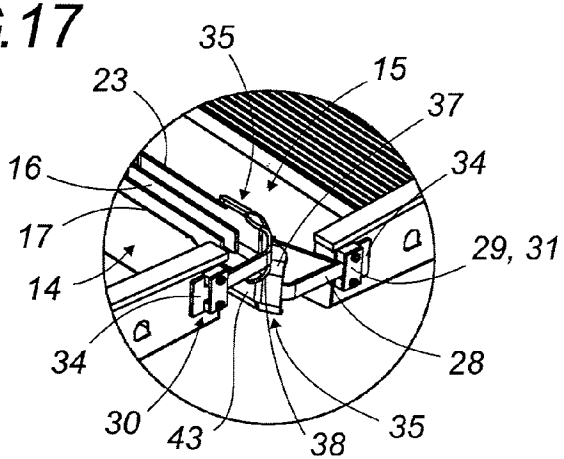
Figure 14:
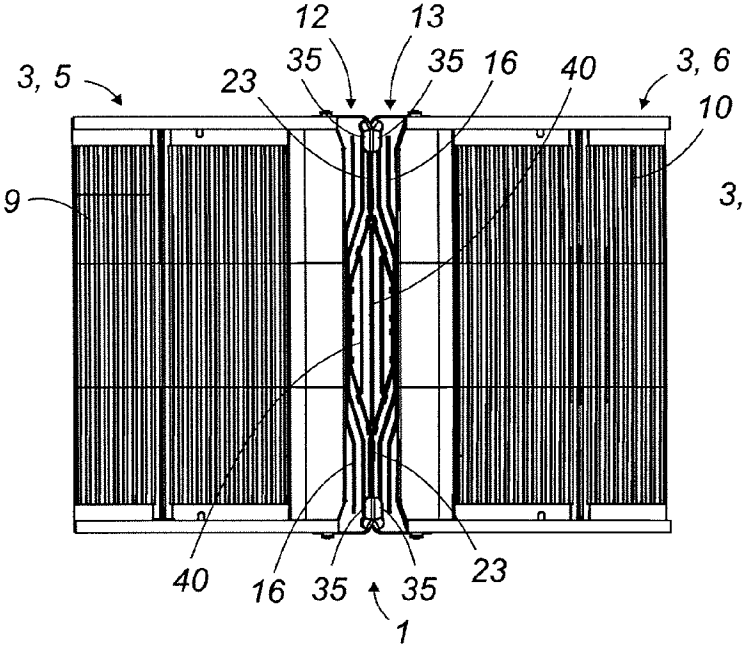
Figure 15:
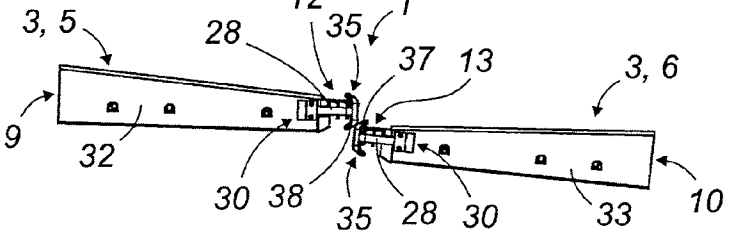
Figure 18:
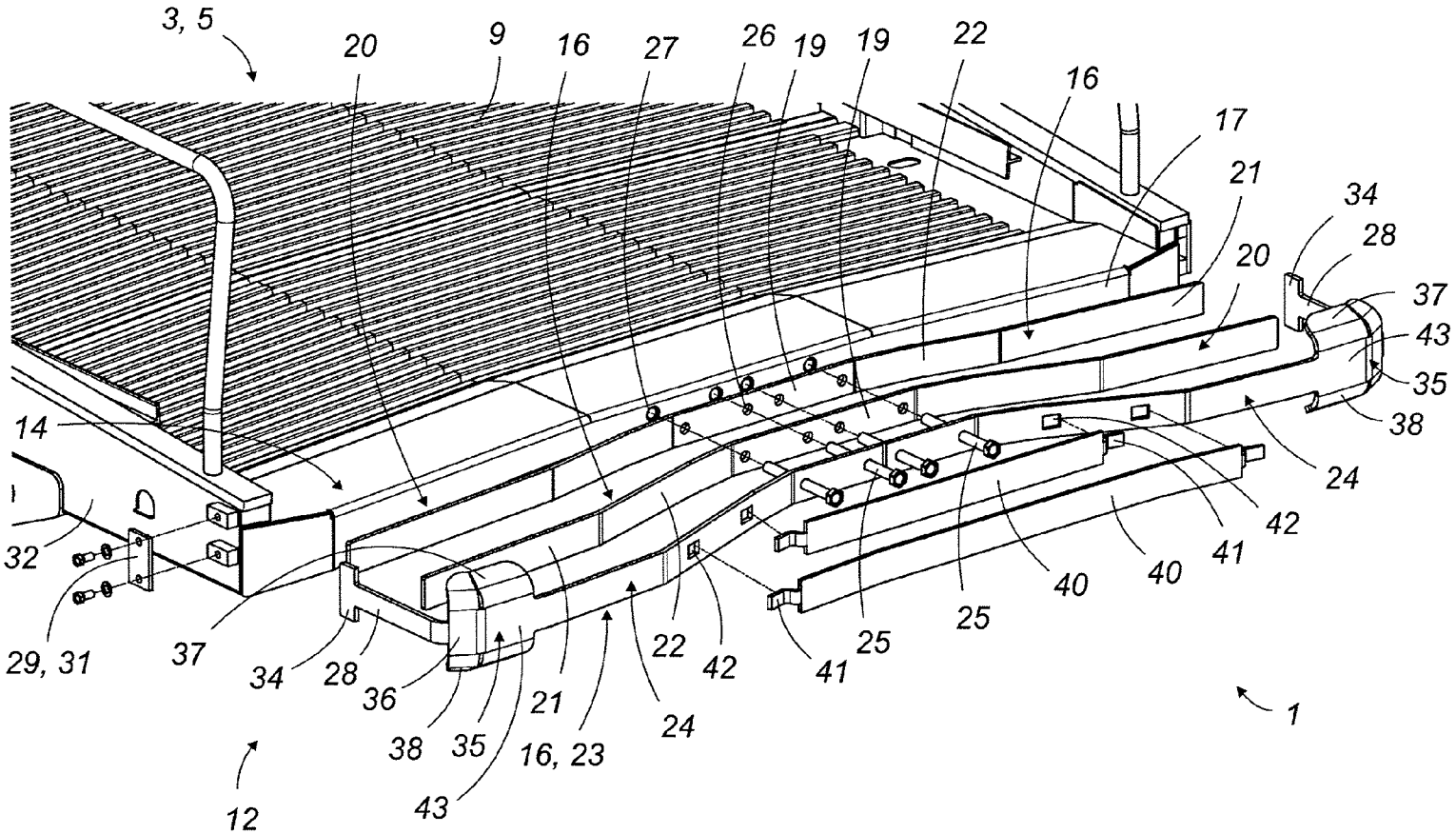
FIG. 18 is an exploded perspective showing the various constituent elements of one of the deformable assemblies of the intercommunicating gangway according to the first embodiment of the invention, attached to the end of one of the plates.

In a simplified version of the invention shown in FIGS. 19 and 20, because of the profile shape of leaves 16, an empty central space 39 appears between deformable assembly 12 and extremity 15 of opposing platform 10, or between the two deformable assemblies 12 and 13 of intercommunicating gangway 1, more precisely at the central portion 19 of leaves 16.

To prevent this empty central space 39 from becoming a fall hazard for pedestrians and even cargo when passing over intercommunicating gangway 1, deformable assembly 12, or each deformable assembly 12, 13 in the preferred embodiment of the invention shown in FIGS. 2 through 18, may comprise at least one bridging leaf 40 located in free space 11 of the central portion 19 of its leaves 16. Empty central space 39 is thus filled by one or more bridging leaves 40.

Bridging leaves 40 are supplemental leaves, preferably generally straight and transverse, that are movable and attached to terminal leaf 23 of each deformable assembly 12, 13 and which gradually lengthen the farther away they are from central portion 19 of terminal leaf 23.

These bridging leaves 40 are hooked by their extremities to oblique lateral blades 22 on each terminal leaf 23. For this purpose they have angled hooking members 41 on their extremities attached in longitudinal openings 42 adapted in length and provided in lateral arms 20, more precisely, in oblique lateral blades 22 in each terminal leaf 23.

The respective motions of opening or moving together lateral arms 20 on terminal leaf 23 increase or decrease, respectively, the distance between oblique lateral blades 22 and therefore the useful length of bridging leaves 40. In order for bridging leaves 40 to have the ability to absorb these respective increases or decreases in useful length, angled hooking elements 41 at the end of bridging leaves 40 may advantageously slide along longitudinal openings 42 in terminal leaf 23 as they are pushed or released, corresponding to oblique lateral blades 22 moving together or opening.

Now the operation of the invention will be examined, which is identical in both modes of embodiments shown. To facilitate the reader's comprehension, the text will refer to FIGS. 2 through 17 in succession.

As shown in FIGS. 2 through 5, when in a straight line and flat, the separation between leaves 16 is uniform. There is a slight play between the two deformable assemblies 12 and 13 in intercommunicating passageway 1 which is identical on two sides of the wheeled bases and depends upon the length of coupling device 4.

During a stop, the separation between the two deformable assemblies 12, 13 must remain small enough for the loading and unloading operations to take place in complete safety. Because of the elastic constraint, when leaves 16 are extended as far as the abutment device that blocks forms 34 against guides 31, intermediate free space 11 between the two successive plates 9, 10 always remains occupied by leaves 16, 23, 40.

If coupling device 4 is short, the two deformable assemblies 12 and 13 may be closer together than in the example shown. They can even be in contact with one another where their contact pieces 35 form a buffer. However, leaves 16 should not be totally compressed while at rest, in order to be capable of deforming freely in both directions for problem-free adaptation to variations caused by travel.

During travel in a straight line, extension or compression movements can be produced depending upon the vehicle's acceleration, deceleration, or braking. During acceleration, there is an extension force that causes intercommunicating gangway 1 to increase in length. This increase is limited, however, by the course of extension abutments 30 described previously.

When the vehicle is taking a curve, intercommunicating gangway 1 of the invention is in the configuration shown in FIGS. 6 through 9.

Extremities 14 and 15 of opposing platforms 9 and 10 move close together on the interior of the curve and separate from one another on the outside of the curve.

Because of this, intercommunicating gangway 1 is compressed on the interior side of the curve and extended on the outside of the curve.

On the interior side of the curve, contact pieces 35 of the two deformable assemblies 12, 13 are in contact and slide against each other. Terminal leaves 23 are pushed toward extremity 14 or 15 on their respective platform 9 or 10, which is accompanied by longitudinal returns 28 sliding inside guides 31. Terminal leaves 23 then begin to compress the other leaves 16 of deformable assembly 12, 13, which are in turn pushed toward corresponding extremity 14 or 15.

When the curve ends, the compression disappears and intercommunicating gangway 1 resumes the straight line configuration described previously due to the natural elasticity of deformable assemblies 12, 13 and the prestressing of leaves 16, 23.

On the outside of the curve, leaves 16 and 23 are in their maximally extended position limited by extension abutment 30, FIGS. 10 through 13 illustrate the behavior of interconnecting gangway 1 of the invention when the vehicle is on a travel surface depression.

In this case deformable assemblies 12 and 13 are compressed at their upper portion. On the two sides of the interconnecting gangway, contact pieces 35 are in contact with their opposing counterpart at their upper surface 37 and eventually at their central portion 43.

In the case of a raised travel surface (not shown), the situation is simply reversed. The intercommunicating gangway is compressed at its lower portion with contact pieces 35 being in contact on their two sides at their lower surface 38.

During combined movements associated with inclines, moving over dips, curves or any other change in the travel surface or the road, the deformability of intercommunicating gangway 1 and the buffering ability of contact pieces 35 combine to absorb variations in the location, orientation and distance between opposing extremities 14, 15 of plates 9, 10 equipping intercommunicating gangway 1 of the invention.

Finally, as shown in FIGS. 14 through 17, intercommunicating gangway 1 allows variations in the height or angle of platforms 9, 10 to occur relative to each other without requiring operator intervention with the intercommunicating gangway.

Actually, the enveloping shape of contact pieces 35 with their upper surface 37 and lower surface 38 serving as a ramps maintains sliding contact between the two deformable assemblies 12 and 13, even when the two assemblies are very close together due to the use of a short coupling 4.

The most adverse situation has been shown in which the two deformable assemblies 12 and 13 are both compressed with their contact pierces 35 touching each other at their central portions 43 when the two plates 9 and 10 are at the same height.

When, for example, one of the plates 9 is lifted up relative to the other plates 10, contact pieces 35 remain in contact with their counterpart, first at their central portion 43 and then between the lower surface 38 of the piece 35 on lifting plate 9 and the upper surface 37 of piece 35 on platform 10 that remains immobile, until lifting plate 9 has passed beyond immobile plate 10.

The angled shape of the upper surface 37 and lower surface 38 acts like a progressive ramp accompanying the withdrawal of the two deformable assemblies 12 and 13. Leaves 16 and 23 on the two deformable assemblies 12 and 13, which were initially compressed, are deployed progressively along with this guided sliding movement until they attain their extension limit when rising platform 9 has passed beyond nonmoving platform 10.

When platform 9 returns to its position, the operation proceeds in a similar way in the reverse direction.

Contact pieces 35 come into contact at the lower surface 38 of upper plate 9 and the upper surface 37 of lower plate 10, while the two deformable assemblies 12 and 13 are in their maximum extended configuration. During the descent of platform 9, contact pieces 35 slide over each other along their angled lower surface 38 and upper surface 37, respectively, which serve as progressive ramps, and leaves 16 and 23 on the two deformable assemblies 12 and 13 become progressively compressed.

Thanks to the particularly advantageous structure of the intercommunicating gangway of the invention, intervention by the operator becomes superfluous, which eliminates the problems of breakage or damage cited in the introduction that are sometimes encountered with the folding flap devices of the prior art.

Although not specifically described, the operation of an intercommunicating gangway 1 comprising only one deformable assembly 12 is similar to that of the intercommunicating gangway comprising two deformable assemblies. It can easily be deduced from the foregoing description.

Obviously the invention is not limited to the preferred embodiments described above and shown in the various drawings, as a person skilled in the art may conceive of numerous modifications and other variations without departing from either the scope or the domain of the invention defined by the claims.

The invention claimed is:

1. A deformable assembly (12) for attachment to an end (14) of either a first platform or a first plate (9) on a wheeled base (3) in a free space (11) separating the first plate (9) from another opposing plate (10) on an adjacent wheeled base in order to form an intercommunicating gangway (1) between the first plate (9) and the opposing plate (10), the deformable assembly comprises an assembly of flexible metal leaves (16), each comprising a central portion (19) extending on each side into a lateral arm (20);

the leaves (16) standing on edges and being juxtaposed against one another in a stack and being attached at their central portion (19) to the end (14) of the first plate (9), with the lateral arms (20) remaining elastically deformable;

a terminal leaf (23) corresponding to the leaf (16) farthest from the end (14) of the first plate (9); and the deformable assembly is independent of the opposing plate (10).

2. The deformable assembly (12) according to claim 1, wherein a transverse dimension of the deformable assembly (12) is generally equal to a width of the first plate (9).

3. The deformable assembly (12) according to claim 1, wherein the leaves are made from a highly elastic metal.

4. The deformable assembly (12) according to claim 1, wherein the leaves (16) are made as a single piece except for the terminal leaf (23) which is formed of two half-leaves (24).

5. The deformable assembly (12) according to claim 1, wherein the leaves (16) have a trough shaped profile with a planar central portion (19) which extends into two oblique lateral blades (22) followed by two end branches (21) either parallel to the central portion or diverging when in a resting position.

6. The deformable assembly (12) according to claim 1, wherein successive leaves (16) have either lateral arms (20) that increase in width from the terminal leaf (23) to a leaf located closest to the extremity (14) of the first plate (9), or lateral arms (20) that are parallel in resting position and a central portion (19) that increases in length from the terminal leaf (23) to the leaf located closest to the extremity (14) of the first plate (9).

7. The deformable assembly (12) according to claim 1, wherein the leaves (16) are maintained in elastic pre-constraint and in the lateral arms (20) of the leaves (16) are free at the ends.

8. The deformable assembly (12) according to claim 1, wherein an extension abutment device (30) limits extension by leaves (16).

9. The deformable assembly (12) according to claim 8, wherein the extension abutment device (30) operates on the terminal leaf (23) of the deformable assembly (12).

10. The deformable assembly (12) according to claim 9, wherein the extension abutment device (30) comprises a longitudinal return (28) which extends each of the lateral arms (20) on the terminal leaf (23) toward the first plate (9), which cooperates with a retention means (29) located on the first plate (9).

11. The deformable assembly (12) according to claim 10, wherein the retention means (29) is a bridge guide (31) attached to a side portion (32) of the first plate (9) within which the longitudinal return (28) slides and which cooperates with an end block (34) on this longitudinal return (28) to limit extension by the leaves (16).

12. The deformable assembly (12) according to claim 1, wherein the terminal leaf (23) has, at an end of each of its lateral arms (20), a contact piece (35) which forms a buffer which has a curved enveloping shape with a central portion (43), a lateral side (36), an upper surface (37) and a lower surface (38) which curve toward the plate.

13. The deformable assembly (12) according to claim 1, wherein at least one bridging leaf (40) is located in the free space (11, 39) at the central portion (19) of the leaves (16).

14. The deformable assembly (12) according to claim 13, wherein each of the at least one bridging leaf (40) is a generally straight and transverse leaf that is movably attached to the terminal leaf (23).

15. The deformable assembly (12) according to claim 14, wherein each of the at least one bridging leaf (40) comprises, at ends thereof, angled hooking members (41) attached within longitudinal openings (42) provided in the lateral arms (20) of the terminal leaf (23) which are capable of sliding along the openings.

16. A first plate (9) for a wheeled base (5) in combination with a deformable assembly (12) attached to an end (14) of the first plate (9) on the wheeled base in a free space (11) separating the first plate (9) from another opposing plate (10) on an adjacent wheeled base in order to form an intercommunicating gangway (1) between the first plate (9) and the opposing plate (10), the deformable assembly comprising:

an assembly of flexible metal leaves (16), each comprising a central portion (19) extending on each side into a lateral arm (20);

the leaves (16) standing on edges and being juxtaposed against one another in a stack and being attached at their central portion (19) to the end (14) of the first plate (9), with the lateral arms (20) remaining elastically deformable;

a terminal leaf (23) corresponding to the leaf (16) farthest from the end (14) of the first plate (9); and the deformable assembly being independent of the opposing plate (10), and the deformable assembly being attached to at least one of the ends (14) of the first plate.

17. An intercommunicating gangway (1) between consecutive first and second platforms or consecutive first and second plates (9, 10) supported by either a wheeled base (3) or by two consecutive wheeled bases (5, 6) separated by a free space (11), the intercommunicating gangway (1) comprising:

at least one deformable assembly (12) for attachment to an end (14) of either the first platform or the first plate (9) on the wheeled base (3) in the free space (11) separating the first platform or the first plate(9) from the opposing second platform or second plate (10) in order to form an intercommunicating gangway (1) between the first platform or the first plate (9) and the opposing second platform or second plate (10), the deformable assembly comprising an assembly of flexible metal leaves (16), each comprising a central portion (19) extending on each side into a lateral arm (20);

the leaves (16) standing on edges and being juxtaposed against one another in a stack and being attached at their central portion (19) to the end (14) of the first platform or the first plate (9), with the lateral arms (20) remaining elastically deformable;

a terminal leaf (23) corresponding to the leaf (16) farthest from the end (14) of the first platform or the first plate (9); and the deformable assembly being independent of the opposing second platform or second plate (10).

18. The intercommunicating gangway (1) according to claim 17, wherein the intercommunicating gangway comprises two deformable assemblies (12, 13), independent of each other and attached so as to face one another in the free space (11) separating the two plates (9, 10), one of the ends (14, 15) of each one facing the consecutive first and second platforms or consecutive first and second plates (9, 10).

* * * * *